United States Patent [19]

Smith

[11] 3,990,268

[45] Nov. 9, 1976

[54] PLUSH FABRIC KNITTING APPARATUS

[75] Inventor: Donald Smith, Ilkley, England

[73] Assignee: I.W.S. Nominee Company, London, England

[22] Filed: Jan. 9, 1974

[21] Appl. No.: 432,096

[30] Foreign Application Priority Data

Jan. 10, 1973 United Kingdom ..... 1377/73

[52] U.S. Cl. ..... 66/92; 66/9 R

[51] Int. Cl.[2] ..... D04B 9/12

[58] Field of Search ..... 66/92, 93, 194, 111, 66/9 R, 141

[56] References Cited

UNITED STATES PATENTS

| | | | |
|---|---|---|---|
| 1,801,167 | 4/1931 | McAdams | 66/93 |
| 2,214,706 | 9/1940 | Holmes | 66/111 |
| 2,903,869 | 9/1959 | Stevens, Jr. | 66/92 |
| 2,933,907 | 4/1960 | Lawson et al. | 66/93 |
| 2,996,904 | 8/1961 | Stevens, Jr. | 66/92 |
| 3,000,199 | 9/1961 | Felker | 66/93 |
| 3,041,859 | 7/1962 | Andersen et al. | 66/92 |
| 3,241,337 | 3/1966 | Stevens, Jr. | 66/9 R |
| 3,477,255 | 11/1969 | Lombardi | 66/92 |
| 3,529,442 | 9/1970 | Gelber et al. | 66/141 X |
| 3,584,478 | 6/1971 | Philip | 66/141 |
| 3,672,186 | 6/1972 | Rab | 66/141 |
| 3,834,190 | 9/1974 | Kuhn | 66/111 |
| 3,874,197 | 4/1975 | Plath | 66/92 X |

FOREIGN PATENTS OR APPLICATIONS

| | | | |
|---|---|---|---|
| 1,816,864 | 7/1970 | Germany | 66/9 R |

*Primary Examiner*—Mervin Stein
*Assistant Examiner*—A. M. Falik
*Attorney, Agent, or Firm*—Harold L. Stowell

[57] ABSTRACT

Plush fabrics are produced on a conventional double jersey knitting machine by feeding a plush yarn to conventional cylinder and dial latch needles and feeding a ground yarn to the dial needles only, whereby long loops are formed in the plush yarn and short loops in the ground yarn; and thereafter causing the cylinder needles to execute a knitting movement without feeding yarn thereto, whereby the long loops are released from the cylinder needles to form the plush pile and cylinder needles are freed for a repetition of the knitting cycle. Some of the conventional feeders on the basic machine are replaced by auxiliary feeders designed to feed yarn to the dial needles only, others may be simply omitted in order to provide for the release of formed loops from the cylinder needles, while others are replaced by ancillary devices to clear released loops from the knitting zone and to open the latches of the cylinder needles for a fresh knitting cycle. The loop pile fabrics produced by this invention can be converted to cut pile fabrics by cropping and sculptured effects can be produced by the application of conventional patterning techniques on the knitting machine.

5 Claims, 6 Drawing Figures

PLUSH FABRIC KNITTING APPARATUS

Figure 1:
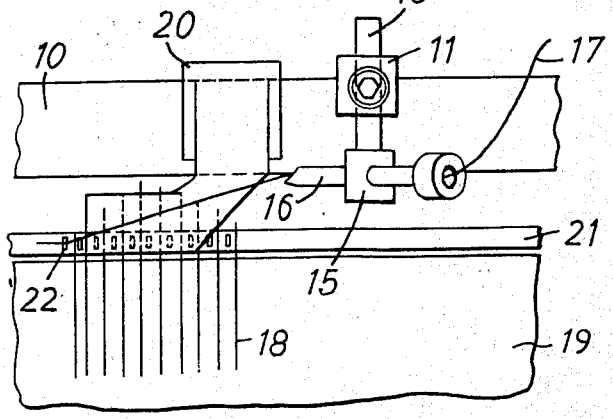

The present invention relates to the production of knitted plush fabrics with loop pile, and more especially to a method of and means for knitting such fabrics on circular knitting machines with cylinder and dial needles, such as a double jersey machine.

Circular knitting machines designed and built to produce double jersey fabrics, whether plain or jacquard, are not usually capable of producing plush fabrics. One form of such machine has been designed for adaptation to produce such fabrics, but the modification involves replacement of all the cylinder needles and many of the cam box sections. Not only is this procedure extremely time consuming, but the necessary attachments and replacement parts are themselves expensive.

The present invention seeks to provide a method of knitting plush fabrics which can be performed on double jersey machines with relatively small modifications and apparatus for attachment to such machines to adapt them for this purpose.

In accordance with this invention a plush fabric is produced, on a circular knitting machine having conventional cylinder and dial latch needles, by feeding a plush yarn to selected cylinder and dial needles and a ground yarn to the selected dial needles only, whereby long loops are formed in the plush yarn and short loops in the ground yarn, and thereafter causing the cylinder needles to execute a knitting movement without feeding yarn thereto, whereby the long loops are released from the cylinder needles to form the plush pile and the cylinder needles are freed for a repetition of the knitting cycle.

In order to carry out the knitting sequence thus broadly defined it is necessary to provide a yarn feeder which will feed yarn to the dial latch needles only and the invention provides, in one aspect of its apparatus, an auxiliary yarn feeder which comprises a yarn guide element providing at least one orifice for passage of a yarn, supporting means for the said element capable of adjustment in both horizontal and vertical directions, and attachment means for releasably securing the supporting means to a knitting machine, preferably on a camplate section, whereby adjustment of the supporting means can bring the orifice to a position behind the cylinder needles, when raised but in front of the dial verge, in order that yarn can be fed directly into the hooks of the dial needles.

According to a further aspect of the invention, there is provided a detachable unit adapted for attachment to the knitting machine, for example to the camplate or cam box thereof, and comprising a loop clearer device to clear the formed plush loops from the knitting zone and guide them through the gap between the dial and the cylinder, and a latch opener device to open all the cylinder needle latches after the formed plush loops have been cleared from the cylinder needles. The loop clearer ensures that the selected cylinder needles in a subsequent operation will not accidentally be passed through the previously pressed-off knitted plush loops. The latch opener prepares the cylinder needles to receive the plush yarn when the needles are next selected.

The apparatus preferably also includes a loop presser member disposed behind the cylinder needles between the feeders and the loop clearer to bear upon the loops on the selected cylinder needles and prevent them from rising and possibly interfering with the movement of the cylinder needle latches.

In addition to these fittings, the preferred apparatus additionally comprises further devices, which may advantageously be combined with the loop clearer and the latch opener in a single detachable unit. The first of these further devices is a latch control deflector adapted to maintain the latches of the cylinder needles in the open position, thereby reducing the risk of their closing after they have passed the latch opener stage and before selection of the cylinder needles for the next operation. Another device is a latch trip indicator which is adapted to be operated by a latch out of position owing to damage or malfunction and operative to give a visual warning or to stop the machine. All the aforementioned devices are preferably adjustably mounted on a common frame which is itself adjustably mountable on the knitting machine.

It will be apparent from the foregoing, and more especially from the detailed description that follows, that various of the devices defined above are of independent utility outside the particular context of modification of a circular knitting machine for plush knitting, and the present invention comprehends such devices whatever be the circumstances of their use or application.

Figure 2:
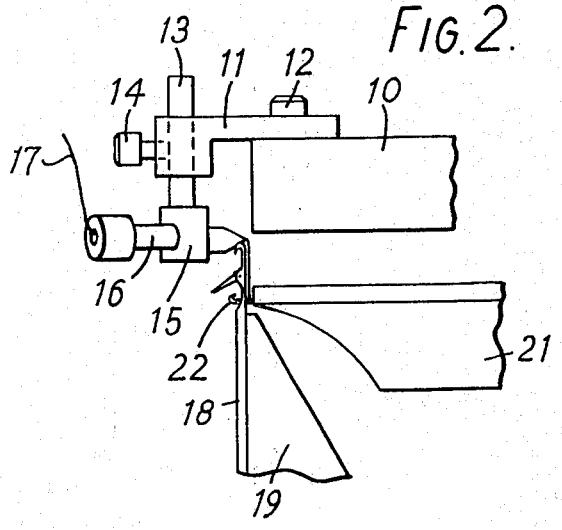
Figure 3:
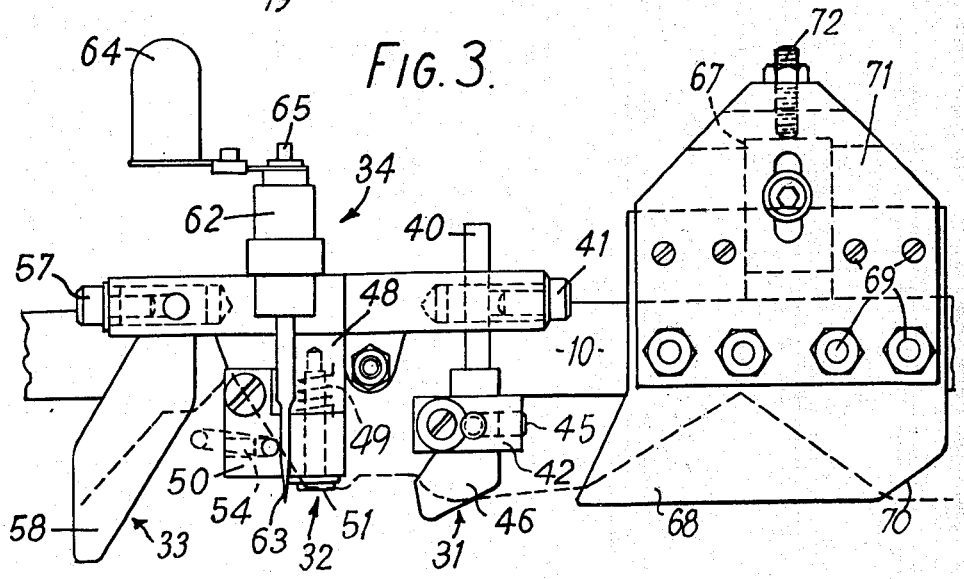
Figure 4:
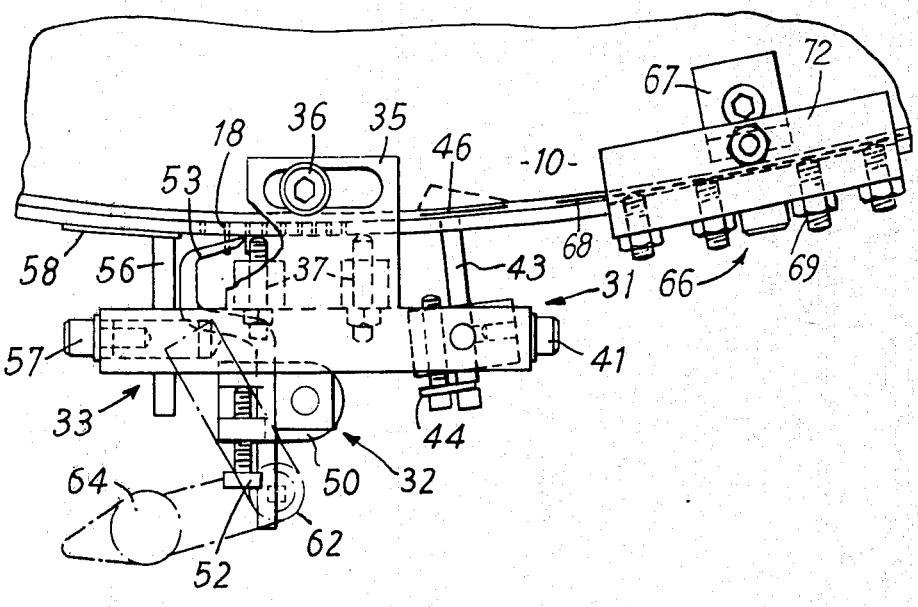
Figure 5:
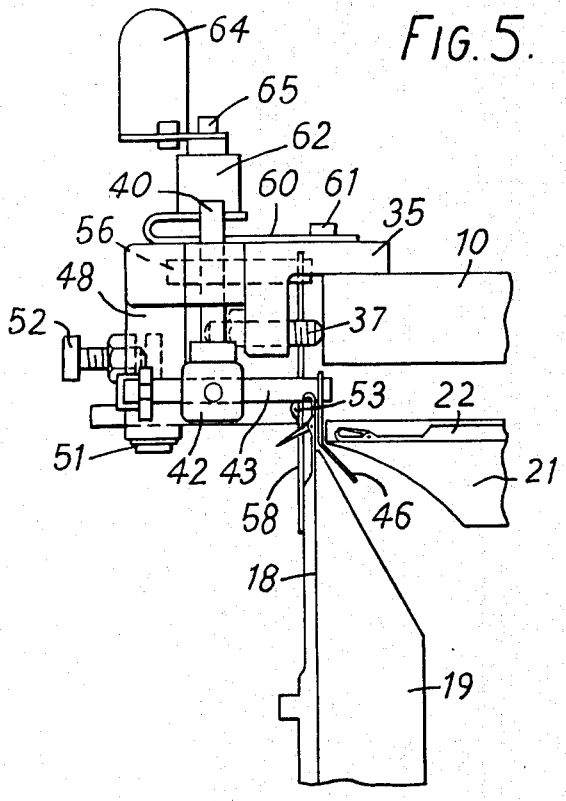

The invention will now be described in greater detail, by way of example, with reference to the accompanying drawings of typical attachments for use in modifying an existing double jersey machine in accordance with the invention. In the drawings:

FIG. 1 is a front elevation and FIG. 2 a side elevation, partly in section, of an auxiliary yarn feeder according to the invention in position on the camplate of the machine; and FIGS. 3, 4 and 5 are respectively a front elevation, a top plan view and a side elevation, partly in section, of a detachable unit combining a loop clearer device, a latch opener device, a latch control deflector and a latch trip switch indicator according to the invention, the unit being mounted on the camplate or box of the machine.

Figure 6:
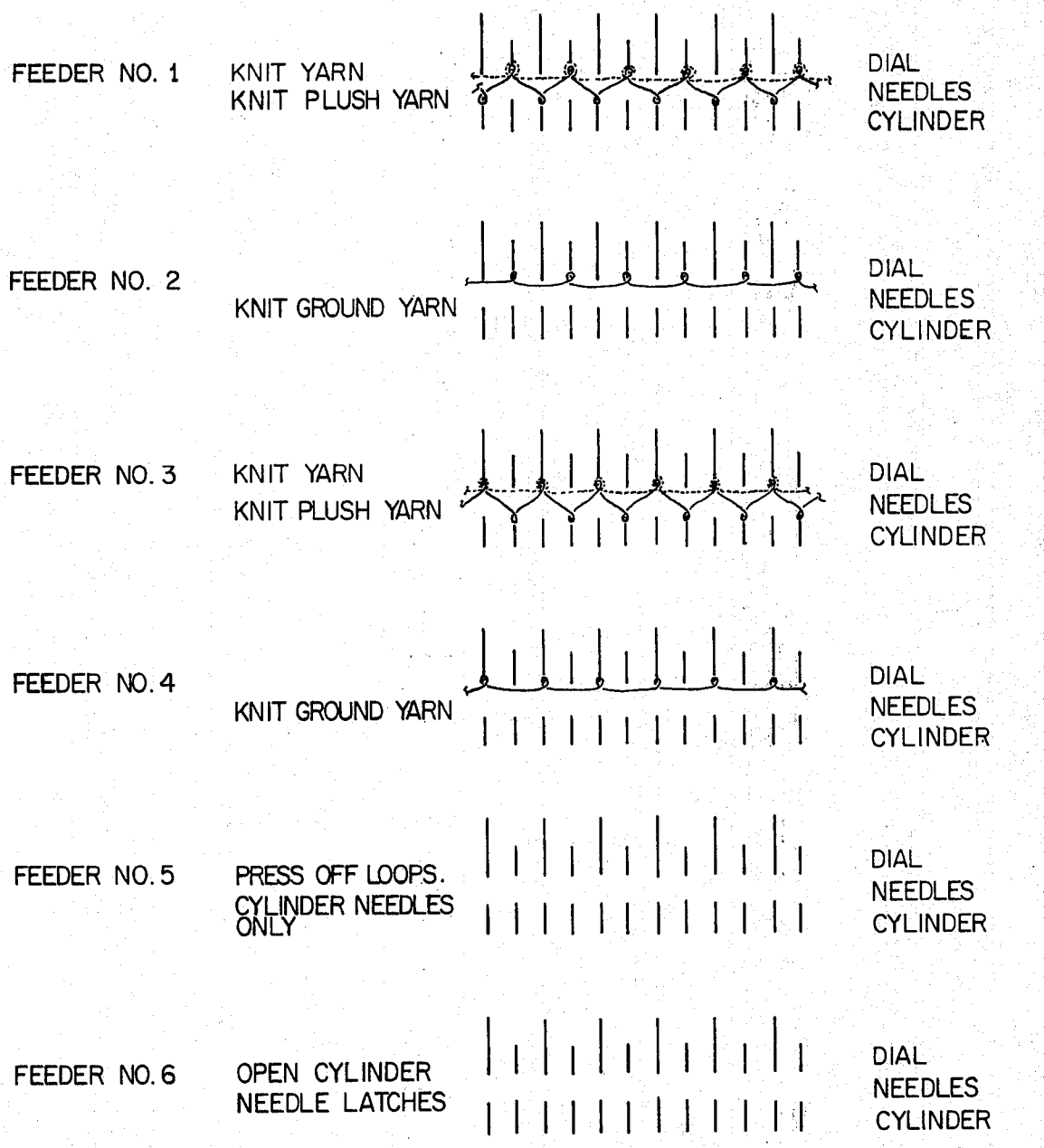

FIG. 6 is diagrammatic representation of a double jersey plush knitting sequence which may be carried out according to the present invention.

The auxiliary feeder shown in FIGS. 1 and 2 is intended for use at selected feeder positions and is there mounted preferably on a camplate section 10 of the machine, in advance of the conventional feeder. As shown in the drawing it comprises a mounting bracket 11 fixed to the camplate section 10 of the machine by a single fixing screw 12, the end of the bracket providing a socket for an adjustable post 13 securable by a clamping screw 14. The post 13 carries at its lower end a supporting socket 15 for a yarn guide tube 16.

In use, the yarn guide tube is adjusted to feed yarn 17 to a position behind the raised cylinder needles 18, shown in the drawing in position in the conventional cylinder 19 of the machine, and behind the conventional feeder, the position of which is shown in broken lines at 20, but in front of the verge of the dial 21 and terminating in the hooks of the dial needles 22.

A tube is preferred to an orifice plate as a yarn guide in order to achieve an enhanced degree of control of the positioning of the yarn and also to reduce feed wear and yarn damage. The various provisions for adjustment of the guide are of importance since correct positioning of the guide is critical. If the guide is set too low it may foul the dial needle latches during the opening stage, if too high the yarn may foul the camplate edge. The angular direction of the yarn path from the guide tube to the receiving dial needles should pass inside the needle latch radius when the needle reaches the normal feed position, otherwise the fed yarn will pass behind the dial needle latch and from this position cannot be knitted.

The detachable unit shown in FIGS. 3, 4 and 5 includes a loop clearer device 31, a latch opener device 32, a latch control deflector 33 and a latch trip indicator 34. The unit is mounted on the camplate 10 of the machine by a single bracket 35, which is secured by a single fixing screw 36, with two set screws 37 for adjustment purposes. It is thus easily and quickly fitted to or removed from the machine.

The loop clearer 31 is carried on an adjustable post 40 secured by a screw 41, and comprises a block 42 from which extends a rod 43 adjustable longitudinally by means of an adjusting screw 44 and a clamping screw 45. The free end of the rod carries a blade 46 which is set to extend through the gap between the cylinder 19 and the dial verge 21, as best seen in FIG. 5. The blade 46 is thus able to assist the clearing of the formed plush loops from the cylinder needles and guide them through the dial and cylinder gap.

The latch opener 32 is mounted beyond the loop clearer 31 and comprises a spring housing 48 containing a cylindrical torsion spring 49 and supporting a block 50 by means of a vertical pivot screw 51, the block being biassed towards the cylinder needles 18 by the spring. An adjusting screw 52 is provided to set a limit to the movement of the block. A latch opening blade 53 is carried by the block 50 and clamped in position by a clamping screw 54.

The blade 53 is adjusted so that the nose of the blade passes between the latch and the hook of each cylinder needle, thereby opening the latches after the plush loops have been formed on and pressed off the cylinder needles. This action prepares the needles to receive the plush yarn when the needles are next selected.

The latch control deflector 33 is mounted beyond the latch opener 32 in order to keep open the latches opened by the latter device. The control deflector device comprises an adjustable rod 56 secured by a clamping screw 57 and carrying on its free end a blade 58 which is positioned close to the open cylinder needles and thereby reduces the risk of the latches closing before cylinder needle selection next occurs.

The latch trip indicator 34 is mounted close to and cooperates with the latch opener 32. It comprises a mounting bracket 60 secured to the unit bracket 35 by a fixing screw 61 and carrying a switch housing 62. The switch housing contains a micro-switch operable by a lever-trip feeler 63 which extends into the vicinity of the end of the latch opener 53. If the blade 53 encounters a damaged or malfunctioning latch that will not open smoothly, it will be deflected against the action of the torsion spring 49 and engage and release or trip the feeler 63, so actuating the trip switch in the housing 62. An indicator lamp 64 is provided to be illuminated when the trip switch is operated. Tripping of the switch may also serve to stop the machine. A reset stud 65 is provided on the switch housing 62 whereby the trip indicator can be reset when the fault has been rectified.

A preferred additional fitting is shown in FIGS. 3 and 4. This is a loop presser member 66 mounted in the vacant position of a conventional feeder not used for the purposes of this invention. The presser member is carried by a block 67 which can be secured to the camplate section 10 and includes a presser blade 68 located behind the cylinder needles where the latter rise before disengaging themselves from the pile loops (as indicated by the broken line). The blade is secured by adjustable screws 69 which enable it to be curved to follow the line of the needles, and has a chamfered lead-in 70.

The presser member keeps the loops on the selected cylinder needles depressed and prevents interference with the movement of the latches in the first stage of disengagement of the needles from the loops.

There will now be described, by way of further example, and in reference to FIG. 6 one typical form of apparatus for carrying out the method of this invention, which comprises a double jersey knitting machine to which the novel attachments provided by the invention have been fitted.

The basic system providing one complete knitting sequence in the example to be described involves six feeder positions or knitting zones of the original machine. In the first feeder position an auxiliary feeder is attached in advance of the existing conventional feeder as shown in FIGS. 1 and 2. In the second feeder position the conventional feeder only is employed. In the third position a second auxiliary feeder is fitted, again in advance of the conventional feeder, while in the fourth position only the conventional feeder is used. In the fifth feeder position no feeder is required, as will be apparent from the description of the knitting sequence given below, but a loop presser member may be mounted here. This is immediately followed by the loop clearer of a unit as shown in FIGS. 3, 4 and 5, the unit itself being fitted in the sixth feeder position, where the latch opening operation occurs.

The following is the preferred knitting sequence to be carried out on a machine modified in the manner just described.

At the first feeder selected alternate cylinder and alternate dial needles 18 and 22 are raised to knit position, that is, even dial needles together with odd cylinder needles. The plush yarn is fed by a conventional feeder, in the normal way, to each of the selected cylinder and dial needles. At the same time a second yarn, the ground yarn, is fed by an auxiliary feeder (FIGS. 1 and 2) to the previously selected dial needles only. As no stitch is formed on the cylinder needles the length of the plush yarn between consecutive plush stitches on the dial needles will be longer than the length of ground yarn between two consecutive ground yarn stitches on the said dial needles.

At the second feeder even dial needles are selected to knit once more and a ground yarn is fed through a conventional feeder.

The knitting action at the third feeder is similar to that at the first feeder except that odd dial needles and selected even cylinder needles are now raised to knit. A conventional feeder is used for the plush yarn while an auxiliary feeder is used for the ground yarn. The fourth feeder action is similar to the second feeder except that a ground yarn is fed by a conventional feeder to odd dial needles only. At this point in knitting, certain cylinder needles retain formed loops of plush yarn in the needle hooks, whilst the dial needles, which have previously knitted plush yarn together with ground yarn, now retain loops formed from the ground yarn only.

At the fifth feeder position all cylinder needles 18 are raised to knit but no yarn is fed, thereby "pressing off" all the plush loops previously formed and retained in the needle hooks. Where a loop presser member is fitted, this helps to ensure trouble-free opening of the latches as the cylinder needles rise and reliable closure of the latches as the needles subsequently fall, thus enabling longer loops to be safely used. These freed cylinder needle loops are then guided by the loop clearer 31 into the gap between the cylinder 19 and dial 21 after the cylinder needle passes through the stitch cam track. At the sixth feeder position all the cylinder needles are again raised to knitting height and the needle latches are opened by the latch opener 32, and when the needles have passed this stage, a latch control deflector 33 ensures that the opened latches do not close, as they might otherwise do owing to various forces and conditions occurring during this operation. By ensuring the latch does not close prematurely it is made certain that the cylinder needle will receive the plush yarn when next presented.

The use of a loop presser member in the position of the fifth feeder enables longer loops and a deeper pile to be formed. This is of value when the loops are to be cropped to form a cut pile, since conventional cropping apparatus requires a sufficient height of pile loops to ensure an even result.

Conventional patterning methods can be used to produce fabrics having a pile only in selected areas, giving a "sculptured" effect. With the possibility of longer loops brought about by the use of loop presser members, more complex sculptured patterns can be produced, in which areas of the fabric bear no pile, other areas a pile of full height and still other areas a pile of intermediate height.

At the end of the sequence, two plush courses have been knitted using six knitting zones or feeder positions. Thus a 36-feeder machine can have up to six complete systems, which results in 12 knitted plush courses for each machine revolution.

I claim:

1. In a circular knitting machine having cylinder and dial latch needles, the improvement for the production of plush fabric comprising: a yarn feeder mounted on said knitting machine to feed plush yarn to cylinder and dial needles; an auxiliary yarn feeder disposed to feed ground yarn to the dial needles only, whereby long plush yarn loops and short ground yarn loops are formed; at least one vacant feeder position whereat the cylinder needles execute a knitting movement without feeding and thereby release the long loops from the cylinder needles; a loop clearer device mounted between the cylinder and dial needles to guide loops released from said cylinder needles through the gap between the dial and the cylinder; and a latch opener device disposed to open all the cylinder needle latches after the plush loops have been cleared therefrom, including a common frame whereon said loop clearer device and latch opener device are mounted, said common frame being adjustably mounted on the knitting machine, and further including a latch control deflector mounted on said common frame and adapted to maintain the latches of the cylinder needles in the open position after they have passed the latch opener stage and before selection of the cylinder needles for the next operation.

2. The improvement according to claim 1 including a latch trip indicator mounted on said common frame and adapted to be operated by a latch out of position owing to damage or malfunction and operative to give a visual warning or to stop the machine.

3. In a circular knitting machine having cylinder and dial latch needles and a multiple of six feeder positions, the improvement for the production of plush pile fabrics which comprises the provision of the following in each group of six feeder positions: at the first feeder position a yarn feeder to feed plush yarn to selected cylinder and dial needles, and an auxiliary feeder to feed ground yarn to the said selected dial needles; at the second feeder position a yarn feeder to feed ground yarn to the dial needles; at the third feeder position a yarn feeder to feed plush yarn to the previously unselected cylinder and dial needles and an auxiliary feeder to feed ground yarn to the said previously unselected dial needles; at the fourth feeder position a yarn feeder to feed ground yarn to the said previously unselected dial needles; at the fifth feeder position no feeder; and at the sixth feeder position a latch opening device to open the latches on the cylinder needles as the latter rise and a latch control deflector to maintain the cylinder needle latches in the open condition as they fall.

4. The improvement according to claim 3 including the provision at the fifth feeder position of a loop presser member disposed behind the cylinder needles in the vicinity of the said vacant feeder position to prevent the loops on the cylinder needles from rising and interfering with the movement of the cylinder needle latches.

5. In a circular knitting machine having cylinder and dial latch needles, the improvement for the production of plush fabric comprising: a yarn feeder mounted on said knitting machine to feed plush yarn to cylinder and dial needles; an auxiliary yarn feeder disposed to feed ground yarn to the dial needles only, whereby long plush yarn loops and short ground yarn loops are formed; at least one vacant feeder position whereat the cylinder needles execute a knitting movement without feeding and thereby release the long loops from the cylinder needles; a loop clearer device mounted between the cylinder and dial needles to guide loops released from said cylinder needles through the gap between the dial and the cylinder; and a latch opener device disposed to open all the cylinder needle latches after the plush loops have been cleared therefrom, including frame means adjustably mounting said loop clearer device and latch opener device and further including a latch control deflector adapted to maintain the latches of the cylinder needle in the open position after they have passed the latch opener stage and before selection of the cylinder needles for the next operation.

* * * * *